US006114101A

United States Patent [19]

Twist

[11] Patent Number: 6,114,101

[45] **Date of Patent: *Sep. 5, 2000**

[54] PHOTOGRAPHIC DEVELOPER/AMPLIFIER COMPOSITIONS

[75] Inventor: Peter Jeffery Twist, Gt. Missenden, United Kingdom

[73] Assignee: Eastman Kodak Company, Rochester, N.Y.

[ * ] Notice: This patent is subject to a terminal disclaimer.

[21] Appl. No.: 08/311,635

[22] Filed: Sep. 23, 1994

[30] Foreign Application Priority Data

Oct. 20, 1993 [GB] United Kingdom ..... 9321656

[51] Int. Cl.[7] ..... G03C 7/407

[52] U.S. Cl. ..... 430/373; 430/414; 430/461; 430/943

[58] Field of Search ..... 430/373, 414, 430/461, 943

[56] References Cited

U.S. PATENT DOCUMENTS

| | | | |
|---|---|---|---|
| 4,219,615 | 8/1980 | Sakai | 430/373 |
| 4,414,305 | 11/1983 | Nakamura et al. | 430/373 |
| 4,469,780 | 9/1984 | Hirai et al. | 430/373 |
| 4,880,725 | 11/1989 | Hirai et al. | 430/373 |
| 4,954,425 | 9/1990 | Iwano | 430/373 |
| 5,200,301 | 4/1993 | Wingender et al. | 430/373 |
| 5,215,875 | 6/1993 | Matejec et al. | 430/505 |
| 5,246,822 | 9/1993 | Evans et al. | 430/429 |
| 5,358,830 | 10/1994 | Twist | 430/399 |
| 5,387,499 | 2/1995 | Earle et al. | 430/373 |

FOREIGN PATENT DOCUMENTS

| | | | |
|---|---|---|---|
| 1075227 | 2/1984 | Russian Federation . | |
| 1 525 700 | 9/1978 | United Kingdom | G03C 5/42 |
| 1 546 739 | 5/1979 | United Kingdom | G03C 5/42 |
| 2 106 660 | 4/1983 | United Kingdom | G03C 7/30 |

*Primary Examiner*—Hoa Van Le
*Attorney, Agent, or Firm*—J. Lanny Tucker

[57] ABSTRACT

An aqueous redox amplifier composition comprising a color developing agent, hydrogen peroxide or a compound which provides hydrogen peroxide and a hydroxylamine compound of the formula:

(I)

or a salt thereof wherein $R^1$ and $R^2$ are each a substituted or unsubstituted alkyl group of 1–4 carbon atoms and wherein the concentration ranges are:

hydrogen peroxide from 0.5 to 10 ml/l (as 30% w/w solution), hydroxylamine compound from 0.5 to 15 ml/l (as an 85% solution of diethylhydroxylamine), and wherein the pH is in the range from 10.5 to 12.

18 Claims, 7 Drawing Sheets

PHOTOGRAPHIC DEVELOPER/AMPLIFIER COMPOSITIONS

FIELD OF THE INVENTION

This invention relates to photographic developer/amplifier solutions useful in redox amplification processes.

BACKGROUND OF THE INVENTION

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, eg addition compounds of hydrogen peroxide; cobalt (III) complexes including cobalt hexammine complexes; and periodates. Mixtures of such compounds can also be used.

A serious problem with developer/amplifier solutions is their stability because they contain both an oxidising agent (eg the peroxide) and a reducing agent (the colour developing agent) which react together spontaneously thus leading to loss of activity in a matter of an hour or two.

In comparison, conventional photographic colour developer solutions suffer loss of activity by aerial oxidation of the colour developing agent. A typical commercial colour developer solution, however, will be stable for a week or two. Both diethylhydroxylamine and hydroxylamine sulphate have been proposed as anti-oxidants for colour developer solutions.

Colour developer solutions for colour negative silver chloride papers do not contain hydroxylamine sulphate because it can act as a black and white developing agent and this severely inhibits dye yield. Instead, diethylhydroxylamine is used because it does not inhibit dye yield.

When using low silver colour papers closely related to currently used silver chloride colour papers to be processed in a redox developer/amplifier it has been found that diethylhydroxylamine works as an effective antioxidant but the bath ceases to be effective after a few hours.

It has now been found that if the pH is raised, the developer/amplifier baths show improved stability on standing.

SUMMARY OF THE INVENTION

According the present invention there is provided an aqueous redox amplifier composition comprising a colour developing agent, hydrogen peroxide or a compound which provides hydrogen peroxide and a hydroxylamine compound of the formula:

(I)

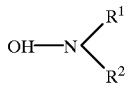

or a salt thereof wherein $R^1$ and $R^2$ are each an alkyl group of 1–4 carbon atoms and wherein the concentration ranges are:

hydrogen peroxide from 0.5 to 10 ml/l (as 30% w/w solution), hydroxylamine compound from 0.5 to 15 ml/l (as an 85% solution of diethylhydroxylamine). and wherein the pH is in the range from 10.5 to 12.

The preferred groups which R1 and R2 may represent are methyl, ethyl, propyl or butyl groups any of which may be substituted with alkyl, alkoxy, aryloxy, carbonamido, carbamoyl, sulphonamido, sulfamoyl, alkylsulphoxyl, arylsulphoxyl, alkylsulphonyl, arylsulphonyl, alkoxycarbonyl, aryloxycarbonyl, acyloxy, ureido, imido, carbamate, cyano, nitro, acyl, trifluoromethyl, alkylthio, carboxyl or heterocylic groups.

The concentration range of the hydrogen peroxide is preferably from 0.5 to 7 ml/l and especially from 0.5 to 2 (as 30% w/w solution).

The concentration range of the hydroxylamine component is from 0.5 to 8 and especially from 0.5 to 4 ml/l hydroxylamine compound (as an 85% solution of diethylhydroxylamine).

The pH is buffered by a phosphate. The pH is preferably in the range 11 to 11.7 and especially from 11 to 11.4.

ADVANTAGEOUS EFFECT OF THE INVENTION

The developer/amplifier solution is stabilised against loss of dye yield and as the solution ages peroxide is slowly lost.

DETAILED DESCRIPTION OF THE INVENTION

The hydroxylamine compound may be dimethylhydroxylamine, diethylhydroxylamine, methylethylhydroxylamine, or dibutylhydroxylamine. The preferred buffer is a phosphate buffer which may be potassium hydrogen phosphate ($K_2H_3PO_4$), carbonates, silicates and mixtures thereof.

The colour photographic material to be processed may be of any type but will preferably contain low amounts of silver halide. Preferred total silver halide coverages are in the range 6 to 300, preferably 10 to 200 mg/m$^2$ and particularly 10 to 100 mg/m$^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The following Examples are included for a better understanding of the invention.

EXAMPLE 1

The developer/amplifier(DA1) is shown in Table 1:

TABLE 1

| Developer/amplifier (DA1) | |
|---|---|
| Sequestrant 1 | 0.6 g/l |
| Sequestrant 2 | 2.0 ml/l |
| $K_2CO_3$ | 25 g/l |
| KBr | 1 mg/l |
| KCl | 0.5 g/l |
| CDS | 0.6 g/l |
| Diethylhydroxylamine (DEH) | 4.0 ml/l |
| CD3 | 3.5 g/l |
| pH | 10.3 |
| $H_2O_2$ (30%) | 5.0 ml/l |
| Time | 45 seconds |
| Temperature | 32° C. |

Where Sequestrant 1 is 60% solution of 1-hydroxy ethylidene-1,1-diphosphonic acid, Sequestrant 2 is a 41% solution of the penta sodium salt of diethylene triamine penta acetic acid and CD3 is N-[2-(4-amino-N-ethyl-m-toluidino)ethyl]-methanesulphonamide sesquisulphate hydrate and DEH is an 85% solution of diethylhydroxylamine.

Figure 1:
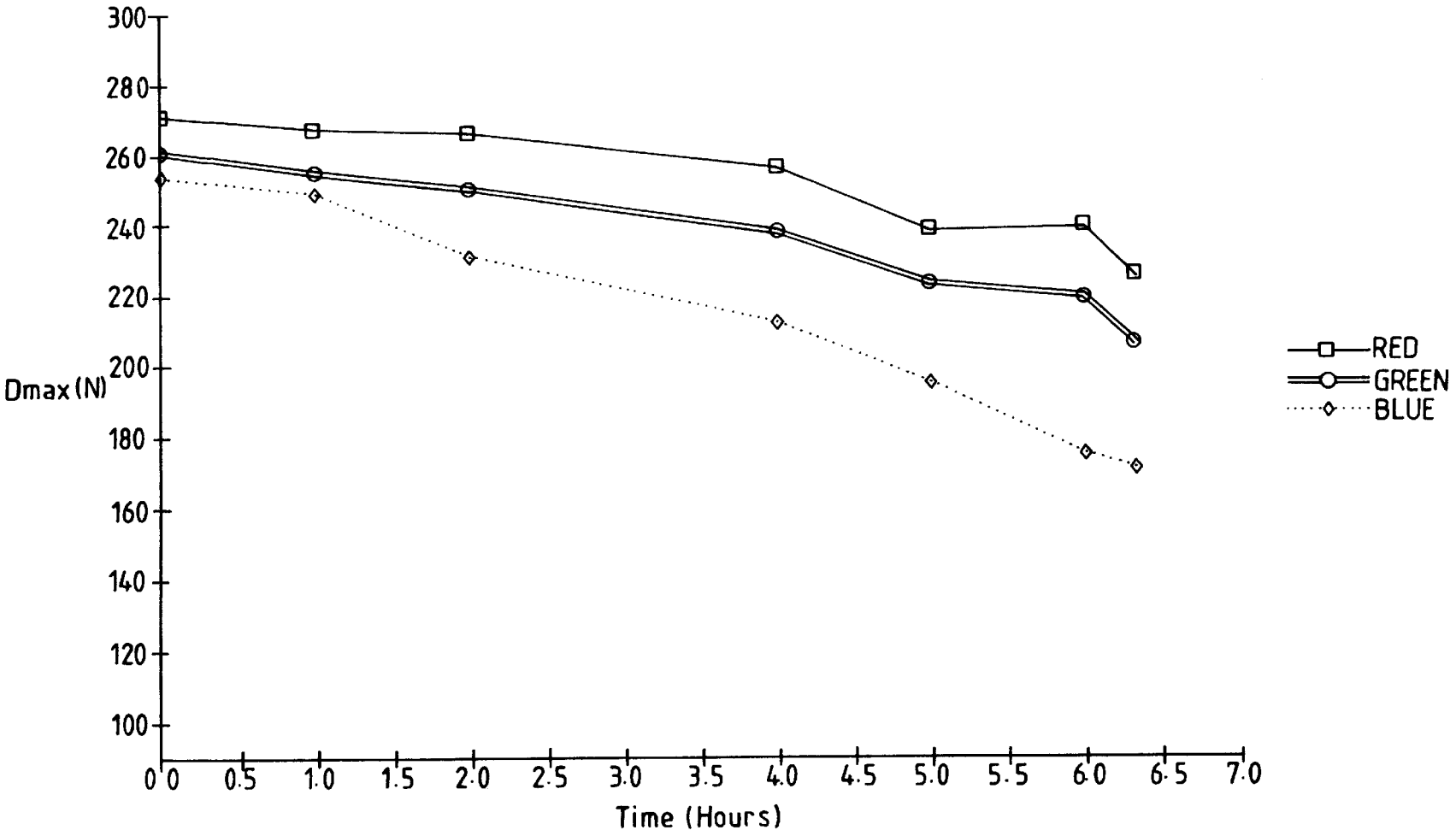
FIGS. 1–7 of the accompanying drawings a graphs representing results from the working Examples below.

A plot of neutral Dmax of a low silver colour paper material (total silver coating weight =123 mg/m$^2$) as a function of the age of solution DA1 is shown in FIG. 1 of the accompanying drawings. It can be seen there is a gradual fall-off in Dmax with time.

Figure 2:
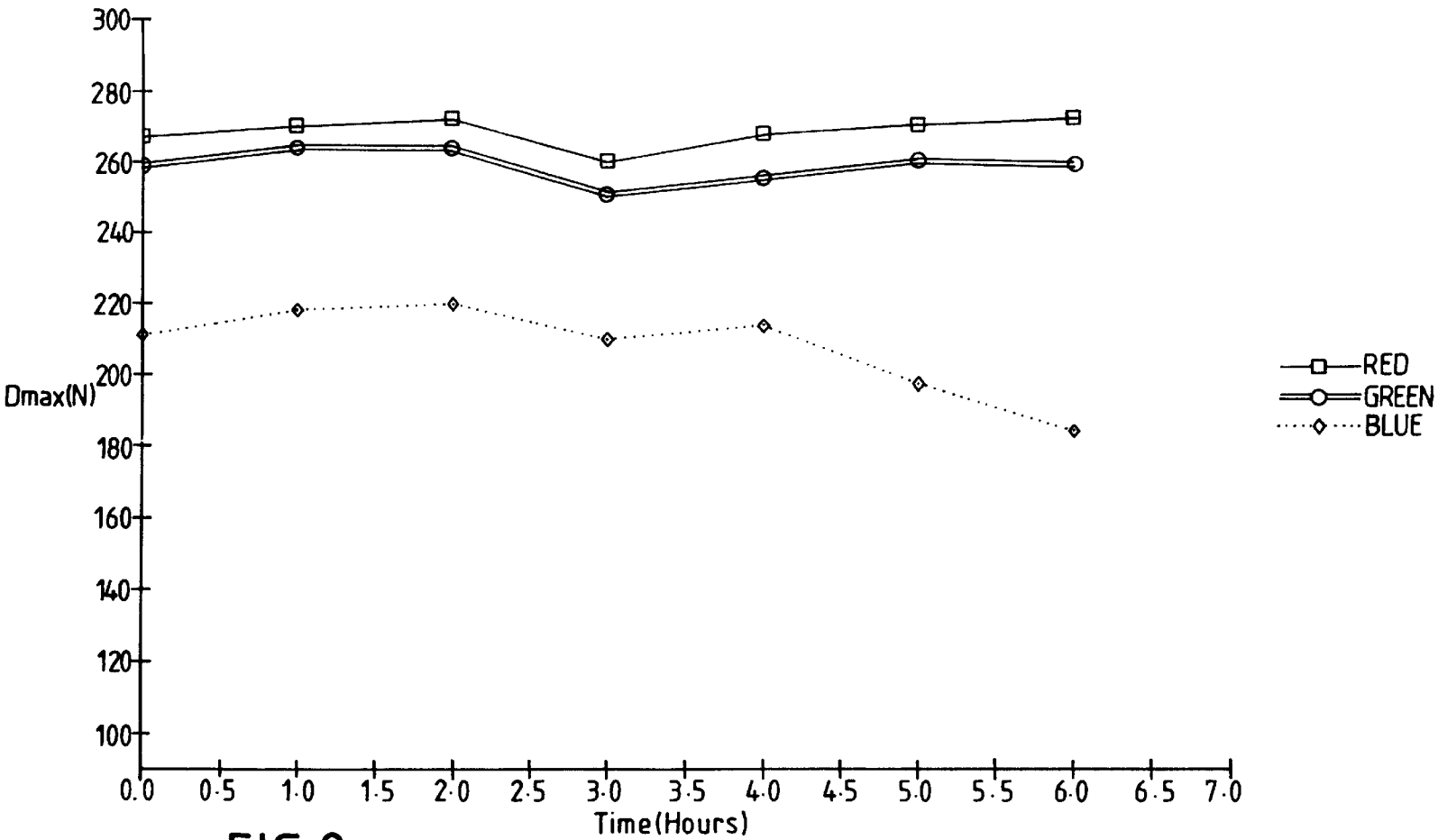

A second developer/amplifier solution DA2 was made by adding potassium hydroxide to DA1 until the pH was 11.0. A plot of neutral Dmax against solution age is shown in FIG. 2. Here there is no significant fall in red and green Dmax with solution age and only a small loss of blue Dmax compared with DA1. Initial blue Dmax is lowered however and this can be corrected by reformulation to give DA3 shown in Table 2 below.

TABLE 2

| Developer/amplifier (DA3) | |
|---|---|
| Sequestrant 1 | 0.6 g/l |
| Sequestrant 2 | 2.0 ml/l |
| $K_2CO_3$ | 25 g/l |

TABLE 2-continued

| Developer/amplifier (DA3) | |
|---|---|
| KBr | 1 mg/l |
| KCl | 0.5 g/l |
| CDS | 0.6 g/l |
| Diethylhydroxylamine (DEH) | 4.0 ml/l |
| CD3 | 3.5 g/l |
| pH | 11.0 |
| $H_2O_2$ (30%) | 3.0 ml/l |
| Time | 45 seconds |
| Temperature | 32° C. |

Figure 3:
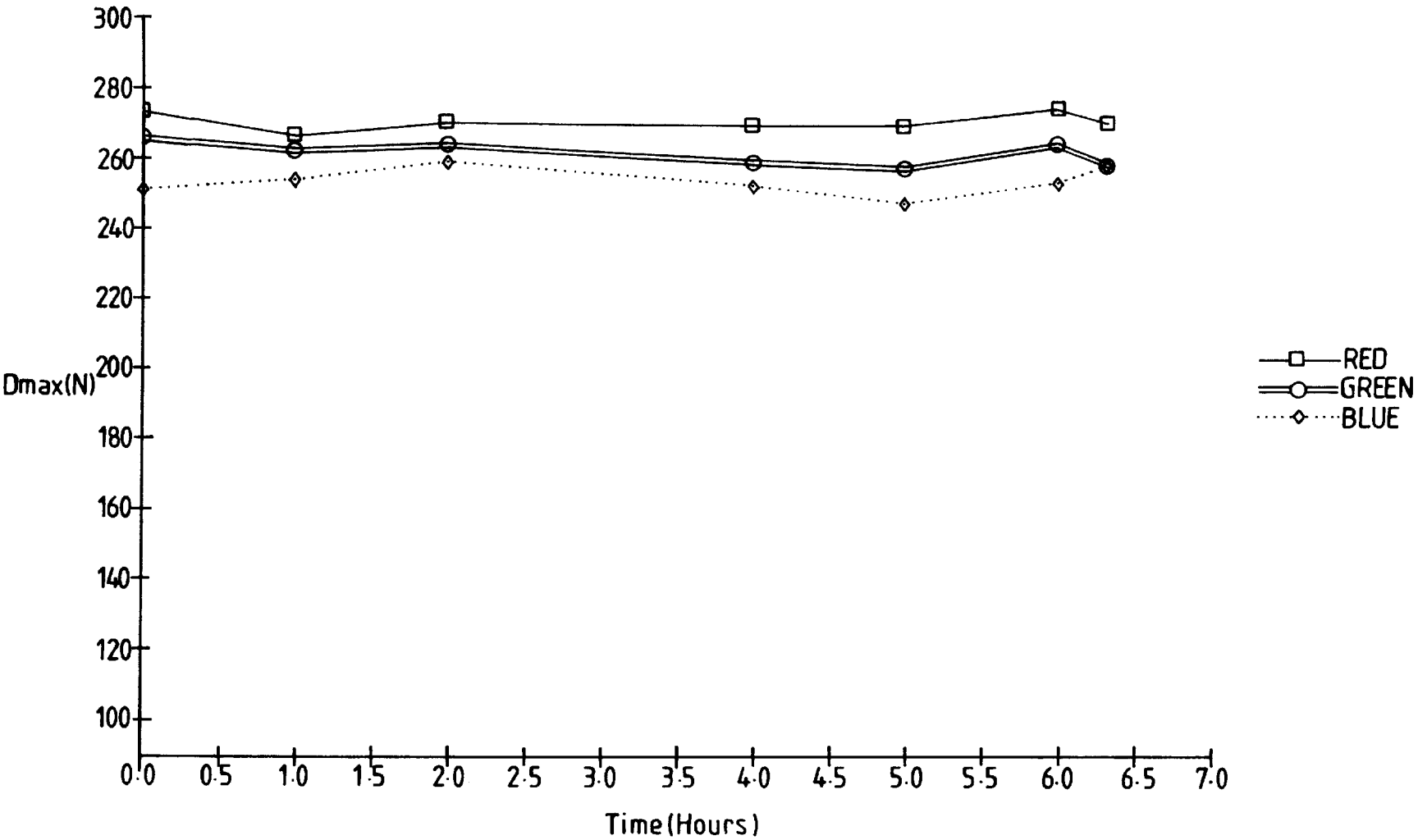

A plot of neutral Dmax against solution age is shown in FIG. 3. Here red, green and blue densitites are the same as for DA1 at the start yet they hardly fall at all over a 6 hour period during which DA1 lost from 15 to 33% depending on the colour record. This improvement in standing ability is partly due to the pH change as evidenced by the small amount of colouration of solutions DA2 and DA3 compared to DA1 on standing and partly due to the reduction in hydrogen peroxide level.

Figure 4:
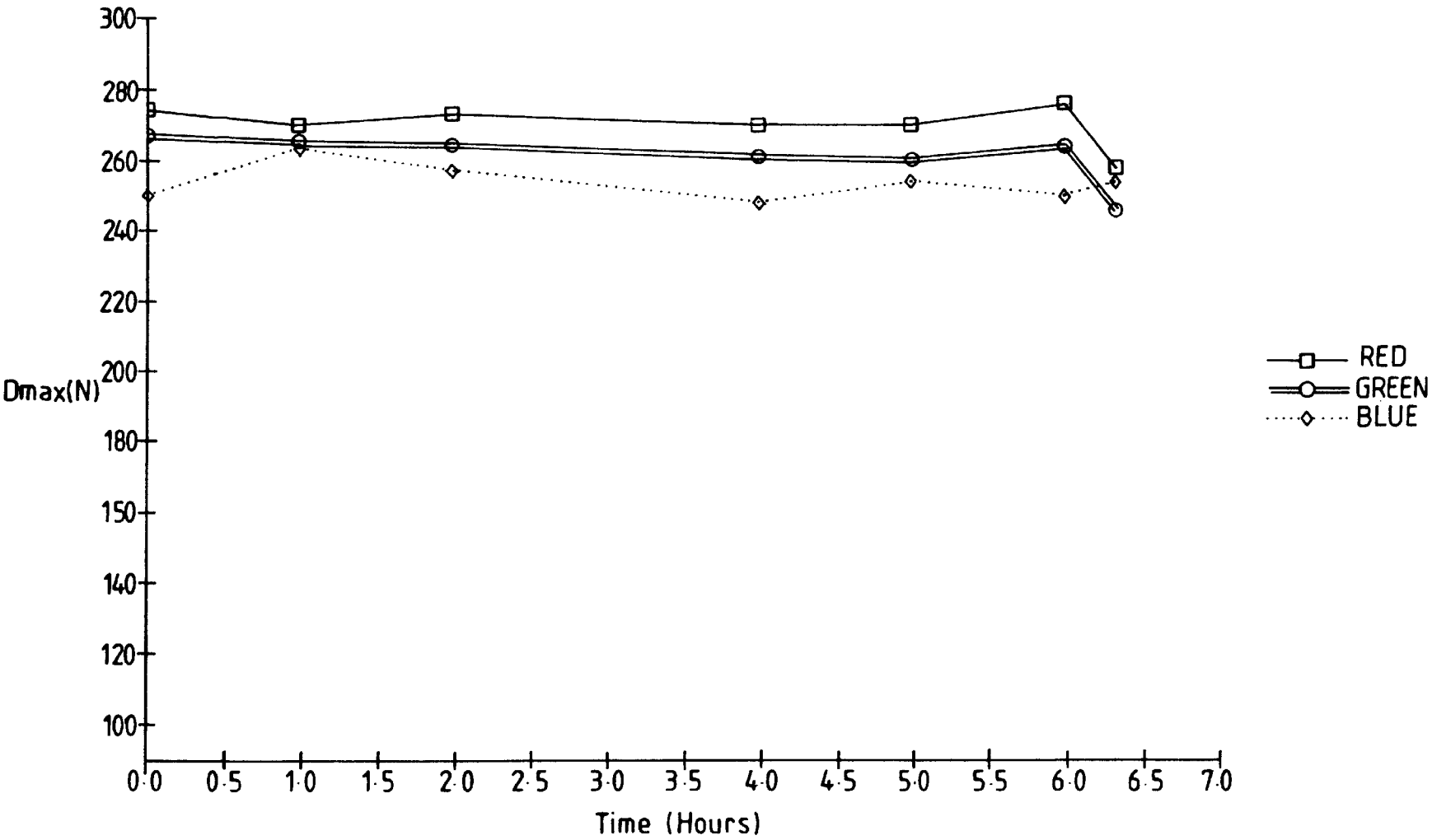

Sodium silicate (15 g/1) is added to DA3 to provide more satisfactory buffering at pH 11.0 solution to make DA4. FIG. 4 shows a similar performance to DA3.

EXAMPLE 2

Figure 5:
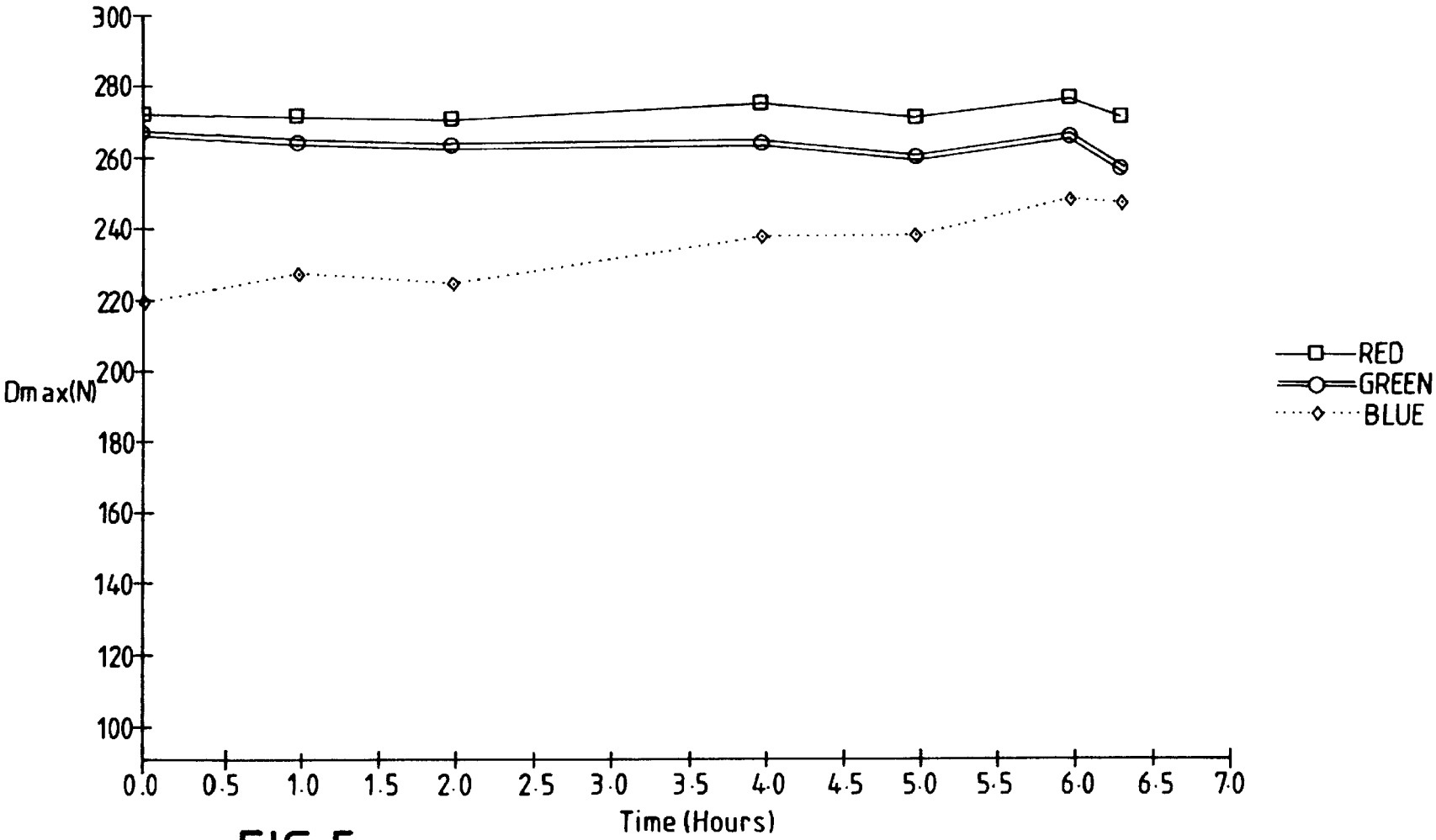
Figure 6:
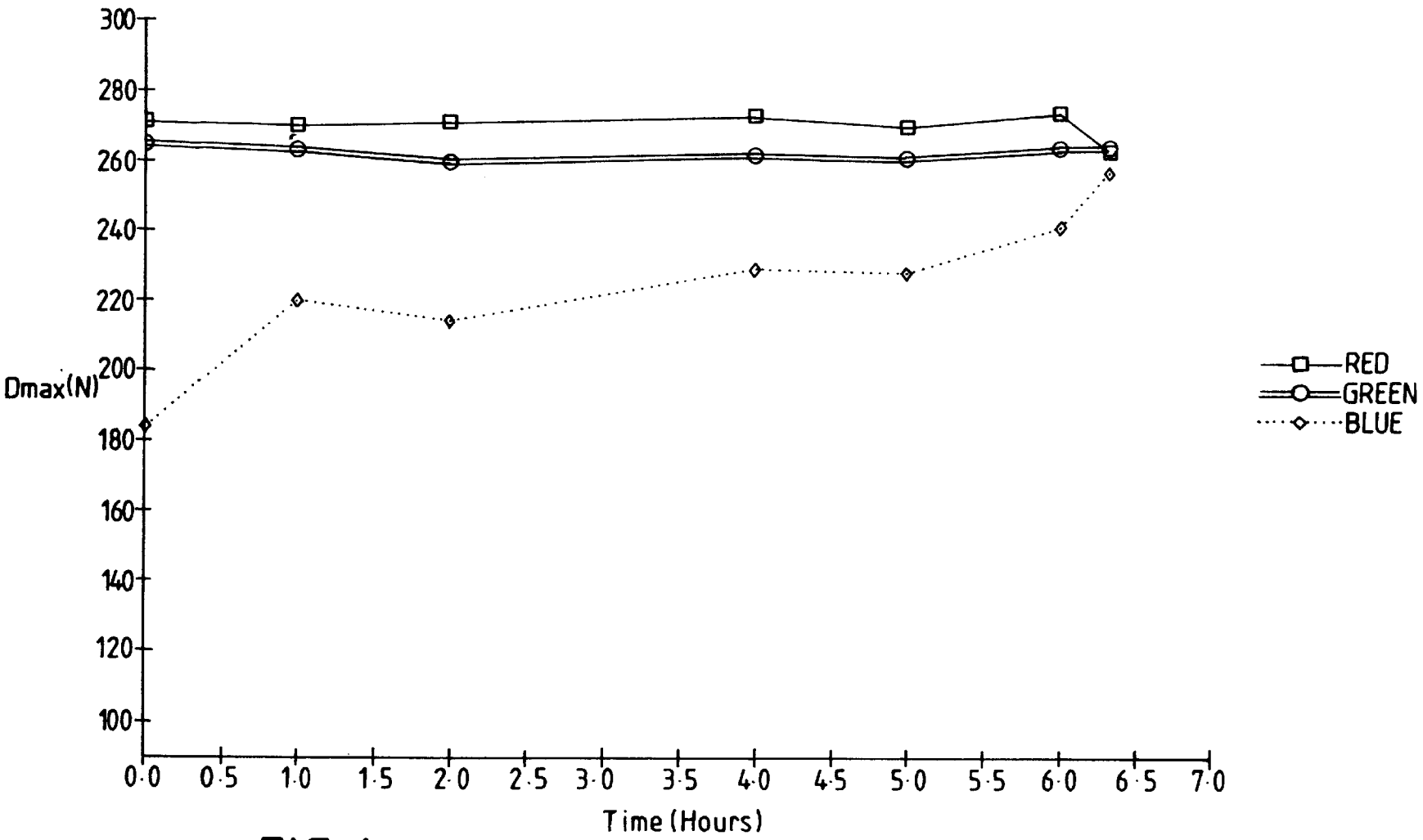
Figure 7:
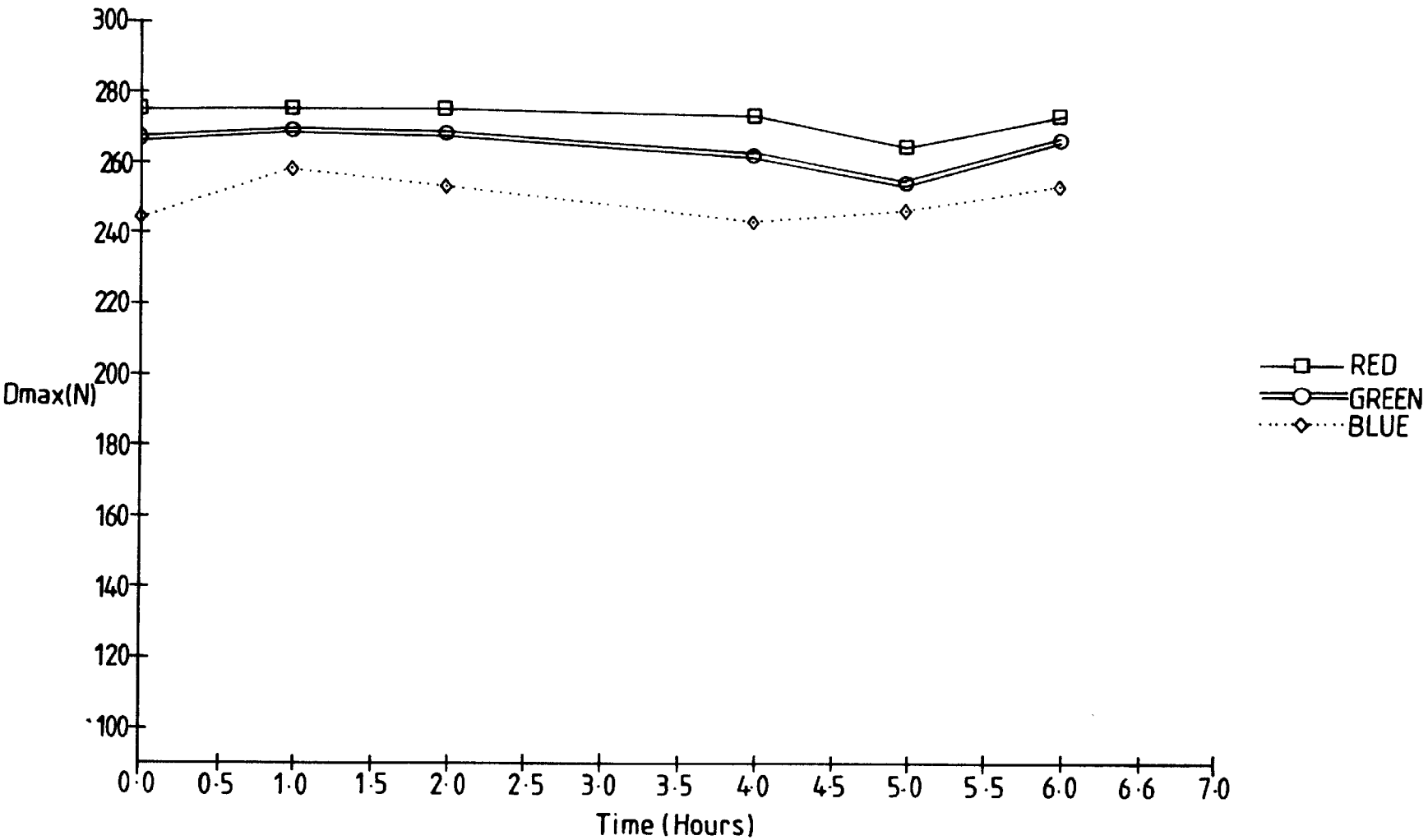

Developer/amplifier DA5 is DA4 whose pH has been raised to 11.5 by addition of potassium hydroxide while DA6 has a pH raised to 12.0. The standing stability results are shown respectively in FIGS. 5 and 6. Here the initial blue layer response is lowered by increasing pH but on standing this returns to be close to normal. If the peroxide level is lowered to 1.5 ml/l (DA7) and the standing stability result is shown in FIG. 7. Here it can be seen that the initial Dmax values for red, green and blue are similar and they remain constant with solution age.

I claim:

1. An aqueous redox amplifier composition comprising a colour developing agent, hydrogen peroxide or a compound which provides hydrogen peroxide and a hydroxylamine compound of the formula:

(I)

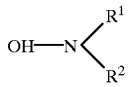

or a salt thereof wherein $R^1$ and $R^2$ are each a substituted or unsubstituted alkyl group of 1–4 carbon atoms and wherein the concentration ranges are:

hydrogen peroxide from 0.5 to 10 ml/l (as 30% w/w solution), hydroxylamine compound from 0.5 to 15 ml/l (as an 85% solution of diethylhydroxylamine), and wherein the composition is buffered by a phosphate to a pH in the range of from 11 to 12.

2. A composition as claimed in claim 1 in which the concentration range of the hydrogen peroxide is from 0.5 to 7 ml/l (as 30% w/w solution).

3. A composition as claimed in claim 1 in which the concentration range of the hydrogen peroxide is from 0.5 to 2 ml/l (as 30% w/w solution).

4. A composition as claimed in claim 1 in which the concentration range of the hydroxylamine component is from 0.5 to 8 ml/l (as an 85% solution of diethylhydroxylamine).

5. A composition as claimed in claim 1 in which the concentration range of the hydroxylamine component is from 0.5 to 4 ml/l (as an 85% solution of diethylhydroxylamine).

6. A composition as claimed in claim 1 in which the pH is from 11 to 11.7.

7. A composition as claimed in claim 6 in which the pH is from 11 to 11.4.

8. The composition of claim 1 wherein either or both of $R^1$ and $R^2$ is substituted with an alkyl, alkoxy, aryloxy, carbonamido, carbamoyl, sulphonamido, sulfamoyl, sulfo, alkylsulphoxyl, arylsulphoxyl, alkylsulphonyl, arylsulphonyl, alkoxycarbonyl, aryloxycarbonyl, acyloxy, ureido, imido, carbamate, cyano, nitro, acyl, trifluoromethyl, alkylthio, carboxyl or heterocyclic group.

9. A method for processing an imagewise exposed colour photographic element comprising contacting said element with an aqueous redox amplifier composition comprising a colour developing agent, hydrogen peroxide or a compound which provides hydrogen peroxide and a hydroxylamine compound of the formula:

(I)

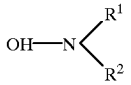

or a salt thereof wherein $R^1$ and $R^2$ are each a substituted or unsubstituted alkyl group of 1–4 carbon atoms and wherein the concentration ranges are:

hydrogen peroxide from 0.5 to 10 ml/l (as 30% w/w solution), hydroxylamine compound from 0.5 to 15 ml/l (as an 85% solution of diethylhydroxylamine), and wherein the composition is buffered by a phosphate to a pH in the range of from 11 to 12.

10. The method of claim 1 wherein said hydrogen peroxide is present in a concentration range of from 0.5 to 7 ml/l (as 30% w/w solution), and said hydroxylamine is present in a concentration range of from 0.5 to 8 ml/l (as an 85% solution of diethylhydroxylamine).

11. The method of claim 9 wherein said composition has a pH of from 11 to 11.7.

12. The method of claim 11 wherein said composition has a pH of from 11 to 11.4.

13. The method of claim 9 wherein said element comprises from 6 to 300 mg/m$^2$ of silver halide.

14. The method of claim 13 wherein said element comprises from 10 to 200 mg/m$^2$ of silver halide.

15. The method of claim 14 wherein said element comprises from 10 to 100 mg/m$^2$ of silver halide.

16. The method of claim 9 wherein said element is a photographic paper having a resin-coated paper support and at least one emulsion layer having more than 80% silver chloride.

17. The method of claim 12 wherein said element has at least one emulsion layer having more than 90% silver chloride.

18. The method of claim 10 wherein either or both of $R^1$ and $R^2$ is substituted with an alkyl, alkoxy, aryloxy, carbonamido, carbamoyl, sulphonamido, sulfamoyl, sulfo, alkylsulphoxyl, arylsulphoxyl, alkylsulphonyl, arylsulphonyl, alkoxycarbonyl, aryloxycarbonyl, acyloxy, ureido, imido, carbamate, cyano, nitro, acyl, trifluoromethyl, alkylthio, carboxyl or heterocyclic group.

* * * * *